US006776367B2

(12) United States Patent
McMurtry

(10) Patent No.: US 6,776,367 B2
(45) Date of Patent: Aug. 17, 2004

(54) SERVO-CONTROLLED TRAVERSE MECHANISM FOR WINDER

(75) Inventor: George W. McMurtry, Belmont, NC (US)

(73) Assignee: R & S Machinery & Design, Inc., Charlotte, NC (US)

( * ) Notice: Subject to any disclaimer, the term of this patent is extended or adjusted under 35 U.S.C. 154(b) by 0 days.

(21) Appl. No.: 10/120,183

(22) Filed: Apr. 10, 2002

(65) Prior Publication Data

US 2003/0192982 A1 Oct. 16, 2003

(51) Int. Cl.[7] ..... B65H 54/28
(52) U.S. Cl. ..... 242/481.4; 242/476.7
(58) Field of Search ..... 242/481.4, 476.7

(56) References Cited

U.S. PATENT DOCUMENTS 3,544,019 A * 12/1970 Lapidas ..... 242/481.4
4,846,772 A * 7/1989 Saruta et al. ..... 474/271
4,948,057 A * 8/1990 Greis ..... 242/481.4
5,499,775 A * 3/1996 Vander Groef ..... 242/476.7
6,196,491 B1 * 3/2001 Kross et al. ..... 242/481.4
6,308,907 B1 * 10/2001 Bartkowiak ..... 242/481.4
6,405,966 B1 * 6/2002 Lieber et al. ..... 242/481.4
6,523,774 B2 * 2/2003 Lenz et al. ..... 242/481.4
2002/0043585 A1 * 4/2002 Lenz et al. ..... 242/481.4

* cited by examiner

*Primary Examiner*—John Q. Nguyen
(74) *Attorney, Agent, or Firm*—Adams Evans P.A.

(57) ABSTRACT

A winding machine for winding a strand onto a tubular support to form a strand package, and including a spindle on the which the tubular support is mounted for rotation therewith. A motor is provided for rotating the spindle. A reciprocating traverse mechanism, including a strand guide, guides the strand onto the tubular support at a predetermined traverse stroke and wind ratio. The traverse mechanism includes servo-motor for selectively starting and stopping reciprocating movement of the strand guide in accordance with the predetermined traverse stroke and wind ratio, and a programmable servo-controller accepts data inputs reflecting the desired traverse stroke and wind ratio and outputting data to the servo-motor reflecting the desired traverse stroke and wind ratio.

6 Claims, 9 Drawing Sheets

SERVO-CONTROLLED TRAVERSE MECHANISM FOR WINDER

TECHNICAL FIELD AND BACKGROUND OF THE INVENTION

This invention relates to a servo-controlled traverse mechanism for a winder, particularly a textile winder used to wind textile strands onto tubular support packages for further processing. The invention relates generally to textile strands such as yarns, filaments or tapes of natural or synthetic materials (all referred to as "yarns") and is particularly concerned with the traversing mechanism necessary for laying the yarn onto the package in a precise, regular pattern. The traditional mechanism for producing such traversing motion includes a grooved scroll or drum which either engages the yarn directly or drives a yarn guide, causing it move in a reciprocating, traversing motion. Such mechanisms are, however, limited in their speed of operation, are subject to mechanical wear, and must be replaced when changing the pattern by which the yarn is to be applied to the package.

Winders for which the invention is suitable include back-winders, rewinders and spoolers, among others. While the system is adaptable to new machines, the particular embodiment disclosed herein is explained by way of example with reference to a Leesona 861 rewinder to which the system has been retrofitted. The system is likewise adaptable to wind both straight-sided cylindrical and tapered packages.

Winding systems are as old as the mechanical processing of yarn. There are numerous types of winders for differing purposes. Recently developed methods of yarn production such as continuous filament extrusion and texturizing have further emphasized this demand for winders having higher speeds of operation. One form of traversing mechanism which has been proposed for operation at such high speeds includes slot-like yarn guides mounted on closely spaced driving members moving in opposite directions across the traverse so that the yarn is carried from one end of the traverse to the other by a guide of one member and is then transferred to a guide of the other member so as to be carried back in opposite direction. This avoids the problem arising from the inertia of the yarn guides or other parts being caused to move first in one direction and then the other with a very abrupt reversal at the end of each traverse. The transfer of the yarn from one guide to another presents its own problems and proposals have been made to include a deflector arrangement at each end of the field of traverse for assisting the transfer of the yarn from one guide to the other. Such traversing mechanisms must be used in conjunction with a package support roller on the winder so that the yarn passes from the yarn guide to a nip between the package and the support roller and is thus maintained under control over this part of its travel.

Other mechanical solutions have been proposed, but all contain inherent limitations arising out of the use of fixed design and machined parts specific to a particular wind.

There are several basic parameters which determine the pattern by which the yarn is applied to the package. These are the wind ratio, traverse length and gain. The wind ratio refers to the number of rotations of the spindle on which the yarn package is positioned for each back-and-forth passage of the yarn traverse. For example, a wind ratio of 6 means that approximately six winds are placed on the package during each back-and-forth passage of the yarn traverse along the length of the package, i.e, three in each direction.

Traverse length refers to the length along the spindle of the yarn applied to the package. The "gain" refers to the minute amount of incremental progression in the placement of the yarn on the package during each traverse to prevent successive wraps of yarn from being placed directly on top of the previous wraps of yarn.

These parameters are well understood in the art. Moreover, efforts have been made to adapt these concepts to electronic systems. For example, the Vander Groef U.S. Pat. No. 5,499,775 Patent discloses a winder for winding a wire cable with a programmable traverse control. The system takes into account the unique problems of winding wire which is subject to kinking and twisting. A "figure 8" package is produced which forms a "hole" at a point where no cross-overs occur during the wire winding process. The stroke of the traverse is slightly out phase with the rotation of the wire spool so that the cross-overs progress around the spool. The number of cross-overs never advances a full 360 degrees around the spindle. Thus, the radial "hole" is formed at the point where no cross-overs are made. The machine is operated by conventional motors.

The present system provides an electronic means of winding textile yarns which permits the various parameters to be controlled by software instead of by hardware. Thus, changes in wind ratios and traverse length can be made by changing the inputs into the system. In addition, a very efficient and effective traverse mechanism is provided capable of operating at the high speeds made possible by the electronic control of the winding process.

SUMMARY OF THE INVENTION

Therefore, it is an object of the invention to provide a winder which utilizes a programmable electronic controller to control various input parameters.

It is another object of the invention to provide a winder which uses a servo-motor to reciprocate a mechanical traverse mechanism efficiently and at high speed.

It is another object of the invention to provide a winder which uses a cable with a helical driving surface to move the traverse at high speed.

It is another object of the invention to provide a winder which utilizes a servo system which both runs the traverse motor and also executes the motion control application which defines the traverse parameters.

It is another object of the invention to provide a winder which is suitable for being retrofitted to a wide variety of existing mechanically-operated winders.

It is another object of the invention to provide a winder which improves machine flexibility, speeds machine setup changes, reduces maintenance costs and reduces machine noise and parts wear.

These and other objects of the present invention are achieved in the preferred embodiments disclosed below by providing a winding machine for winding a strand onto a tubular support to form a strand package, and comprising a spindle on which the tubular support is mounted for rotation therewith, a motor for rotating the spindle, and a reciprocating traverse mechanism, including a strand guide, for guiding the strand onto the tubular support at a predetermined traverse stroke and wind ratio. The traverse mechanism comprises a servo-motor for selectively starting and stopping reciprocating movement of the strand guide in accordance with the predetermined traverse stroke and wind ratio; and a programmable servo-controller for accepting data inputs reflecting the desired traverse stroke and wind ratio and for outputting data to the servo-motor reflecting the desired traverse stroke and wind ratio.

According to one preferred embodiment of the invention, the spindle is rotated at a constant strand winding speed. A speed sensor is provided for detecting the surface speed of the strand package. A spindle motor speed controller accepts a signal output from the speed sensor representing the surface speed of the strand package and outputs a signal representing the surface speed of the strand package. The signal is sent to the spindle motor speed controller for slowing the rpm of the spindle as the diameter of the strand package increases to maintain a constant spindle surface winding speed, and to the servo-controller for slowing the traverse servo-motor in synchronization with the slowing of the rpm of the strand package and thus maintaining a constant wind ratio.

According to another preferred embodiment of the invention, the traverse mechanism comprises a drive cable pulley carried by the servo-motor for rotation therewith, a driven cable pulley positioned in spaced-apart relation to the driven pulley, and a drive cable having first and second opposed ends attached to and carrying the strand guide. The drive cable extends around the drive cable pulley and driven cable pulley for being reciprocated by the starting and stopping reciprocating movement of the servo-motor under control of the servo-controller for moving the strand guide back-and-forth along the length of the spindle as the strand is wound onto the tubular support.

According to another preferred embodiment of the invention, said drive cable comprises a core member around which is wound a spiral member in a predetermined angle and spacing to define raised driving convolutions on the surface of the core. The drive cable pulley and said driven cable pulley are each provided with a plurality of regularly-spaced helical grooves on an outer peripheral driving surface thereof complementary with the driving convolutions on the surface of the core of the drive cable.

According to yet another preferred embodiment of the invention, the core member comprises a bundle of stranded stainless steel wire encapsulated in a flexible elastomeric jacket.

According to yet another preferred embodiment of the invention, said strand support is a constant diameter tube, and said strand comprises a textile yarn.

According to yet another preferred embodiment of the invention, said strand support is a cone, and said strand comprises a textile yarn.

According to yet another preferred embodiment of the invention, said winding machine comprises a machine selected from the group consisting of a rewinder, take-up winder, and two-for-one twister.

An embodiment of the method of winding a strand onto a tubular support to form a strand package according to the invention comprises the steps of providing a spindle on the which the tubular support is mounted for rotation therewith, a motor for rotating the spindle, and a reciprocating traverse mechanism, including a strand guide, for guiding the strand onto the tubular support at a predetermined traverse stroke and wind ratio. Data inputs are generated reflecting the desired predetermined traverse stroke and wind ratio. Data is output to a servo-motor driving the strand guide, said data reflecting the desired traverse stroke and wind ratio. The servo-motor is selectively started and stopped under the control of a servo-controller and thus the reciprocating movement of the strand guide in accordance with the predetermined stroke and wind ratio.

According to yet another preferred embodiment of the invention, the method includes the steps of rotating the spindle at a constant strand winding speed; detecting the surface speed of the strand package, and outputting a signal representing the surface speed of the strand package to a servo-controller. A signal is output representing the surface speed of the strand package for slowing the rpm of the spindle as the diameter of the strand package increases to maintaining a constant spindle surface speed, and to the servo-controller for slowing the traverse servo-motor in synchronization with the slowing of the rpm of the strand package and thus maintaining a constant wind ratio.

According to yet another preferred embodiment of the invention, the step of reciprocating the traverse mechanism comprises the steps of providing a drive cable pulley carried by the servo-motor for rotation therewith, providing a driven cable pulley positioned in spaced-apart relation to the driven pulley, and providing a drive cable having first and second opposed ends attached to and carrying the strand guide, said drive cable being passed around the drive cable pulley and driven cable pulley for being moved in opposite directions by the starting and stopping reciprocating movement of the servo-motor under control of the servo-controller for moving the strand guide back-and-forth along the length of the spindle as the strand is wound onto the tubular support.

According to yet another preferred embodiment of the invention, the drive cable comprises a core member around which is wound a spiral member in a precise predetermined angle and spacing to define raised driving convolutions on the surface of the core. The drive cable pulley and said driven cable pulley are each are provided with a plurality of regularly-spaced helical grooves on an outer peripheral driving surface thereof complementary to the raised driving convolutions on the drive cable.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
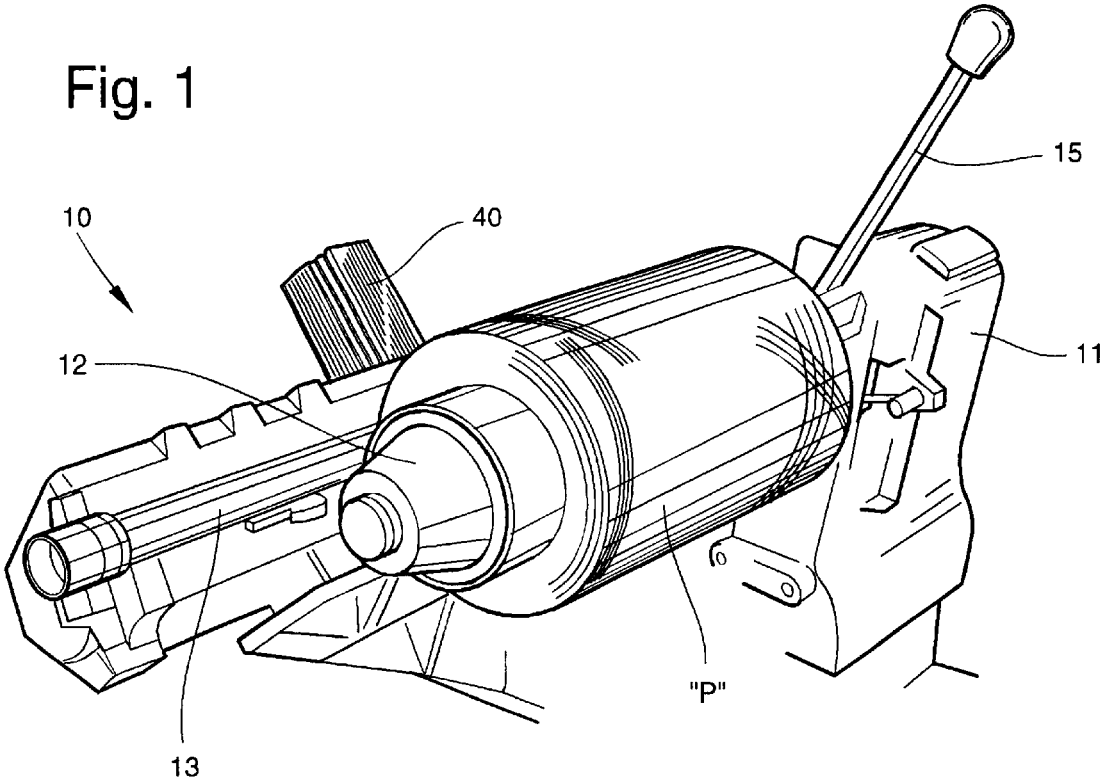
FIGS. 1 and 2 are perspective views of a winder station equipped with the servo traverse assembly according to a preferred embodiment of the invention.

Referring now specifically to the drawings, a servo traverse assembly according to the present invention is illustrated in FIG. 1 and shown generally at reference numeral 10. The assembly 10 is mounted on a base 11 carried by a conventional machine frame. A take-up spindle 12 is mounted for movement between a position, FIG. 1, where a yarn package "P" is donned and doffed, and a winding position, FIG. 2. A roll 13 rides on the surface of the package "P" to control pressure during the winding process. Roll 13 also has a 6-tooth pulse wheel (not shown) mounted on its end which provides pulses to a magnetic device which outputs a signal to the spindle motor 52 which drives spindle 12.

Figure 2:
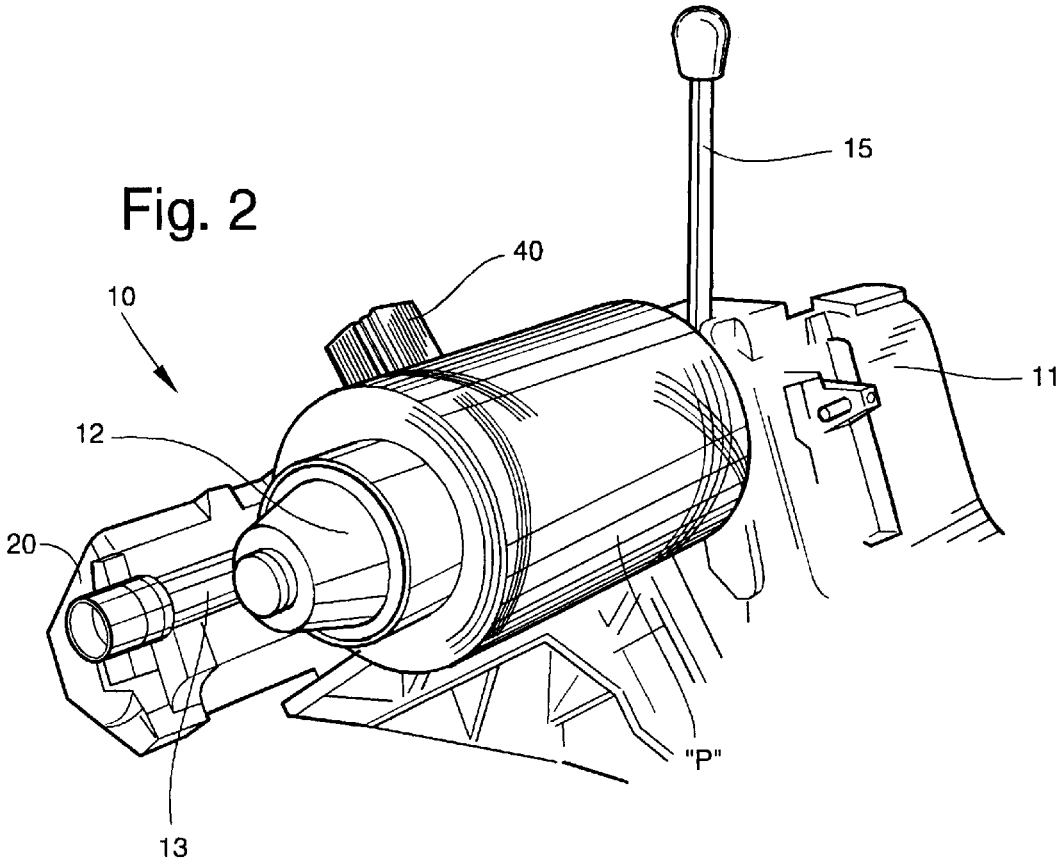
Figure 3:
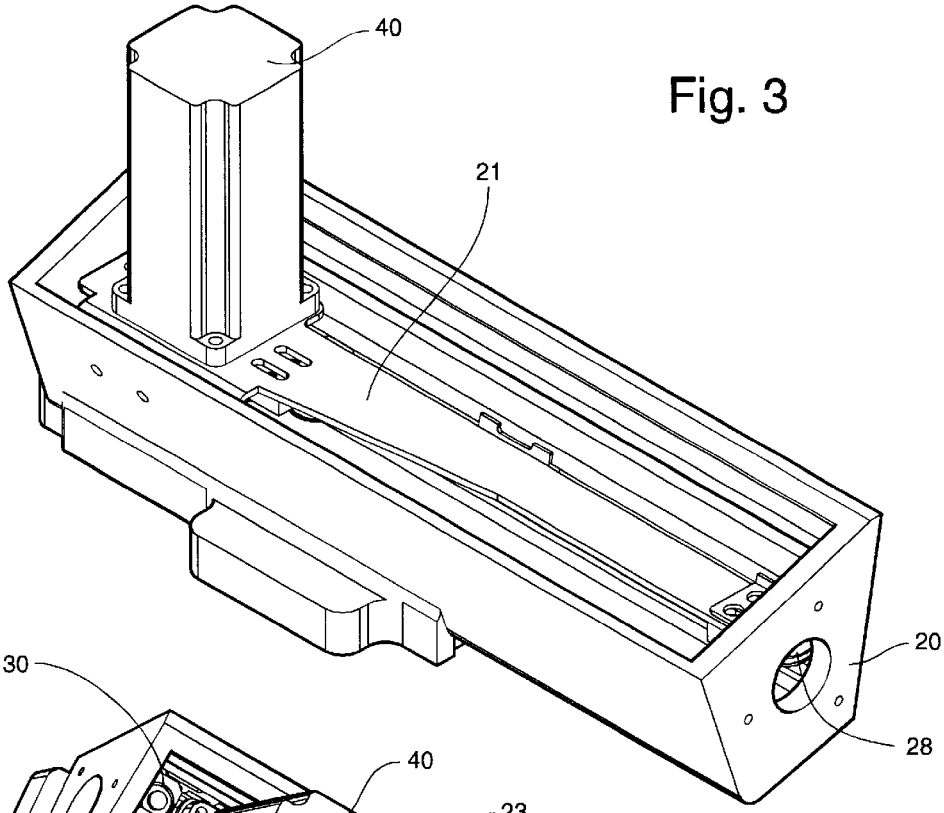
FIG. 3 is a perspective view of a servo traverse assembly according to a preferred embodiment of the present invention.
Figure 4:
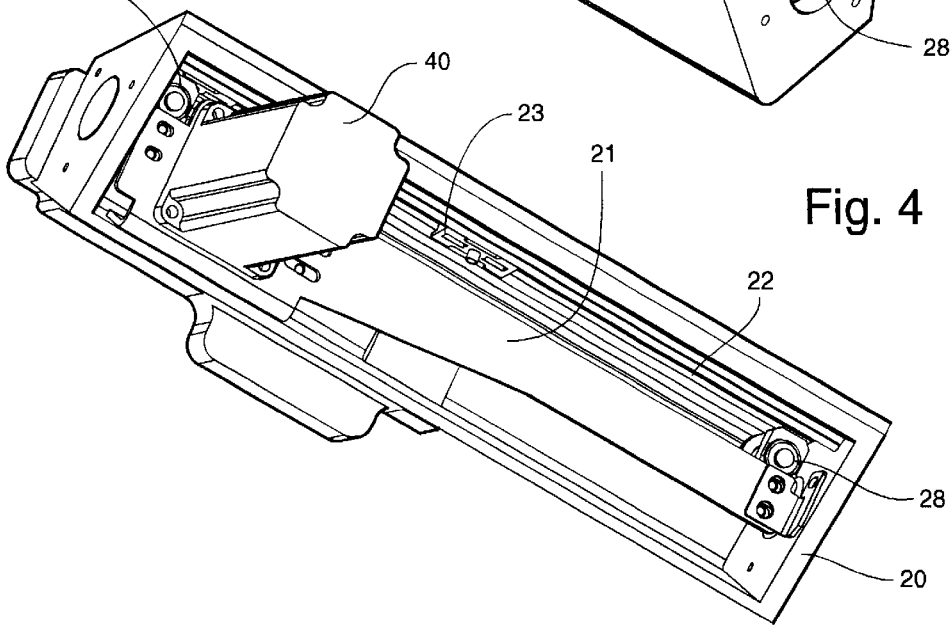
FIG. 4 is a second perspective view of a servo traverse assembly according to a preferred embodiment of the present invention.

A handle 15 is used to move the spindle 12 into and out of the two positions shown in FIGS. 1 and 2. These features are conventional and therefore not further described.

In accordance with the invention, yarn is wound onto the package "P" by a traverse mechanism positioned in a housing 20 and driven by a servo-motor 40. The housing 20 is positioned alongside the spindle 12 in the ordinary manner and permits yarn from a supply package, not shown, to be wound onto the package "P." The servo traverse assembly 10 is capable of winding yarn in accordance with any pattern or wind configuration, and the resulting "P" package is visually indistinguishable from packages wound by conventional means. The invention is usable on either a constant yarn speed system whereby, as the diameter of the package "P" increases the rpm of the spindle 12 decreases, or on a constant spindle speed system.

The traverse mechanism is best shown in FIGS. 3–7. A motor pulley bracket 21 carries the servo-motor 40 on one end. The servo-motor 40 drives a drive cable 22 to which is mounted a cable traverse guide 23. The cable traverse guide 23 is carried by a traverse guide rail 26 which extends along the length of the housing 20. The drive cable 22 is mounted for reciprocating motion on driven pulley assemblies 28, 29 and 30 driven by a drive pulley 31 mounted on the output shaft of the servo-motor 40.

The servo-motor 40 according to the preferred embodiment disclosed herein is an Allen-Bradley Part No. 193521, with a peak torque of 33.7 in./lbs. The drive cable is a synchromesh cable such as disclosed in U.S. Pat. No. 4,846,772, and has a helical driving surface to move the traverse at high speed. Prior art uses of this cable include driving the printing head of printers and plotters. The helical driving surface is formed by a helically-applied polyurethane strand around a nylon-coated core of 304 stainless steel. One suitable product is made by SDP Inch. The pulleys 28, 29, 30 and 31 each have a peripheral surface with helical groove segments therein which mate with the strand. The drive cable 22 is particularly suited for high-speed reciprocation around sharp angles, and is both highly precise and reliable. The cable 22 has a very low mass and thus low inertia. This allows very rapid reciprocations without cable deformation.

Figure 5:
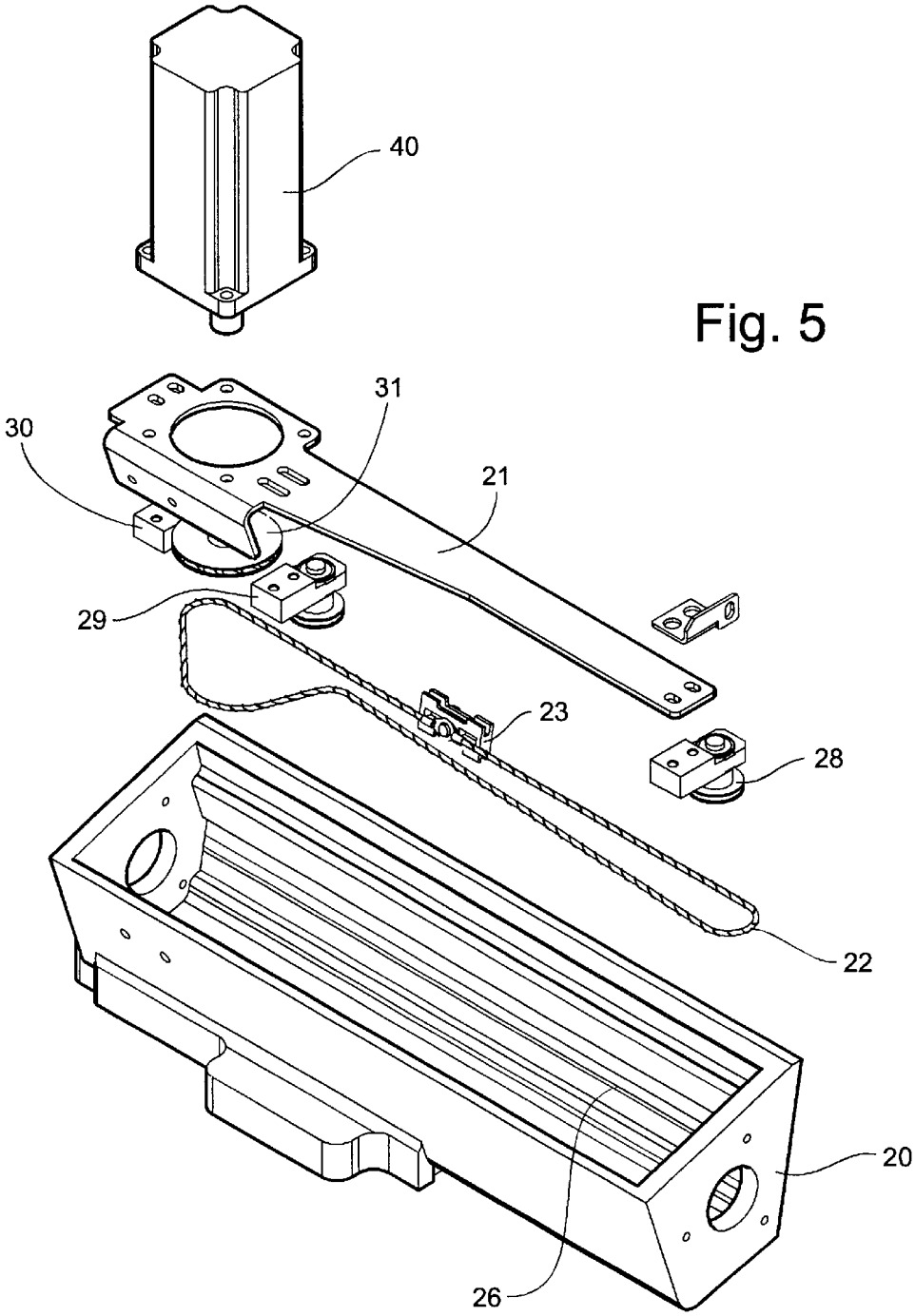
FIG. 5 is an exploded perspective view of a servo traverse assembly according to a preferred embodiment of the present invention.

As is best shown in FIG. 5, opposite ends of the drive cable 22 are attached to opposite ends of the cable traverse guide 23. One suitable traverse length is 10 inches, but other longer or shorter traverse lengths may be used.

Figure 6:
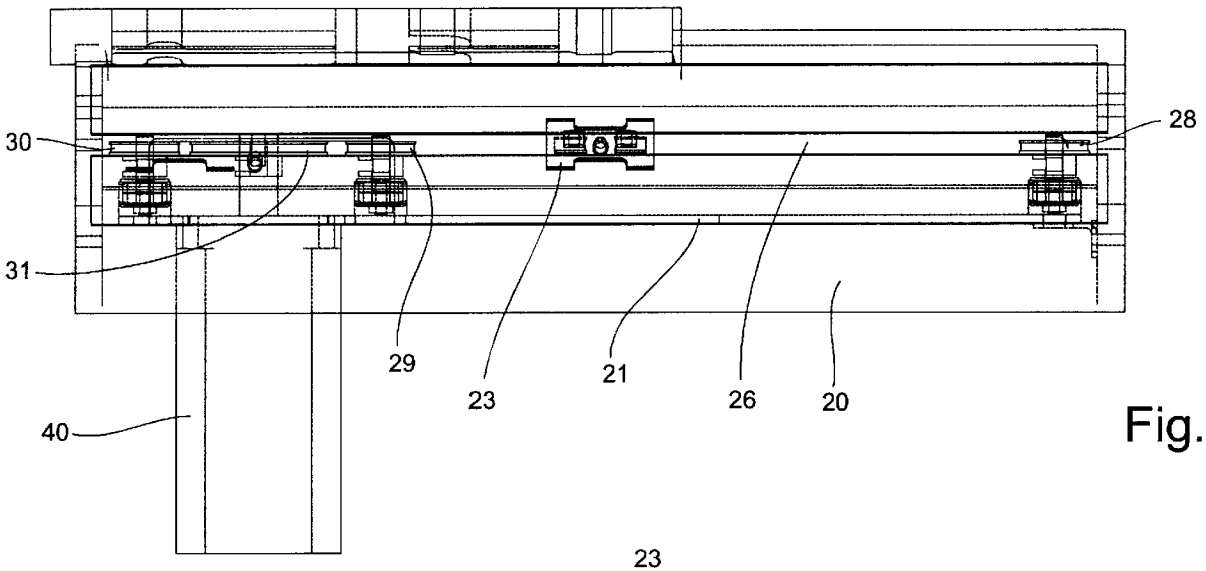
FIG. 6 is a front elevation of the servo traverse assembly.
Figure 7:
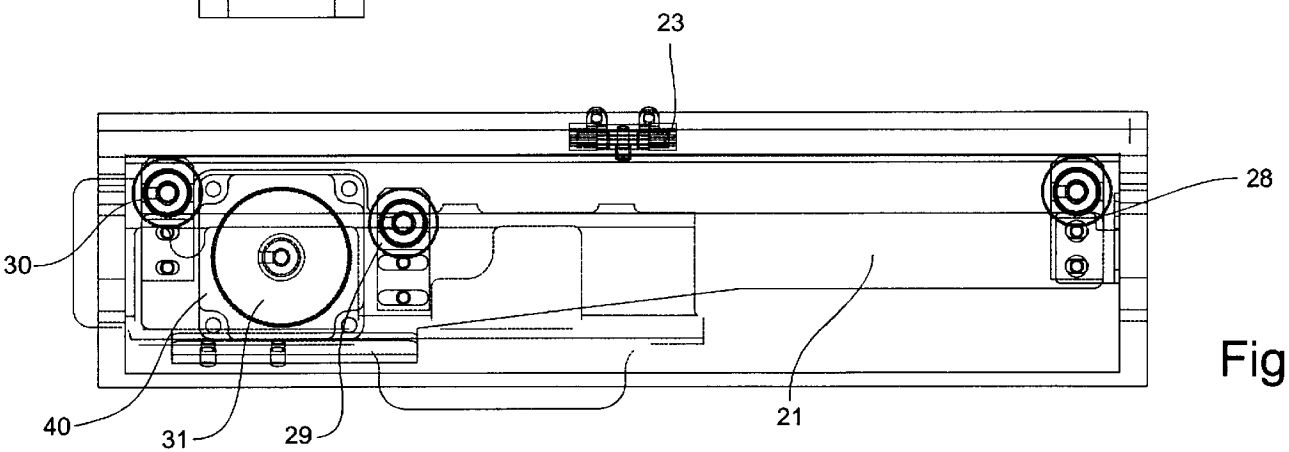
FIG. 7 is a top plan view of the servo traverse assembly.

Further details of the cable and pulley arrangement are shown in FIGS. 6 and 7.

Figures 8, 9:
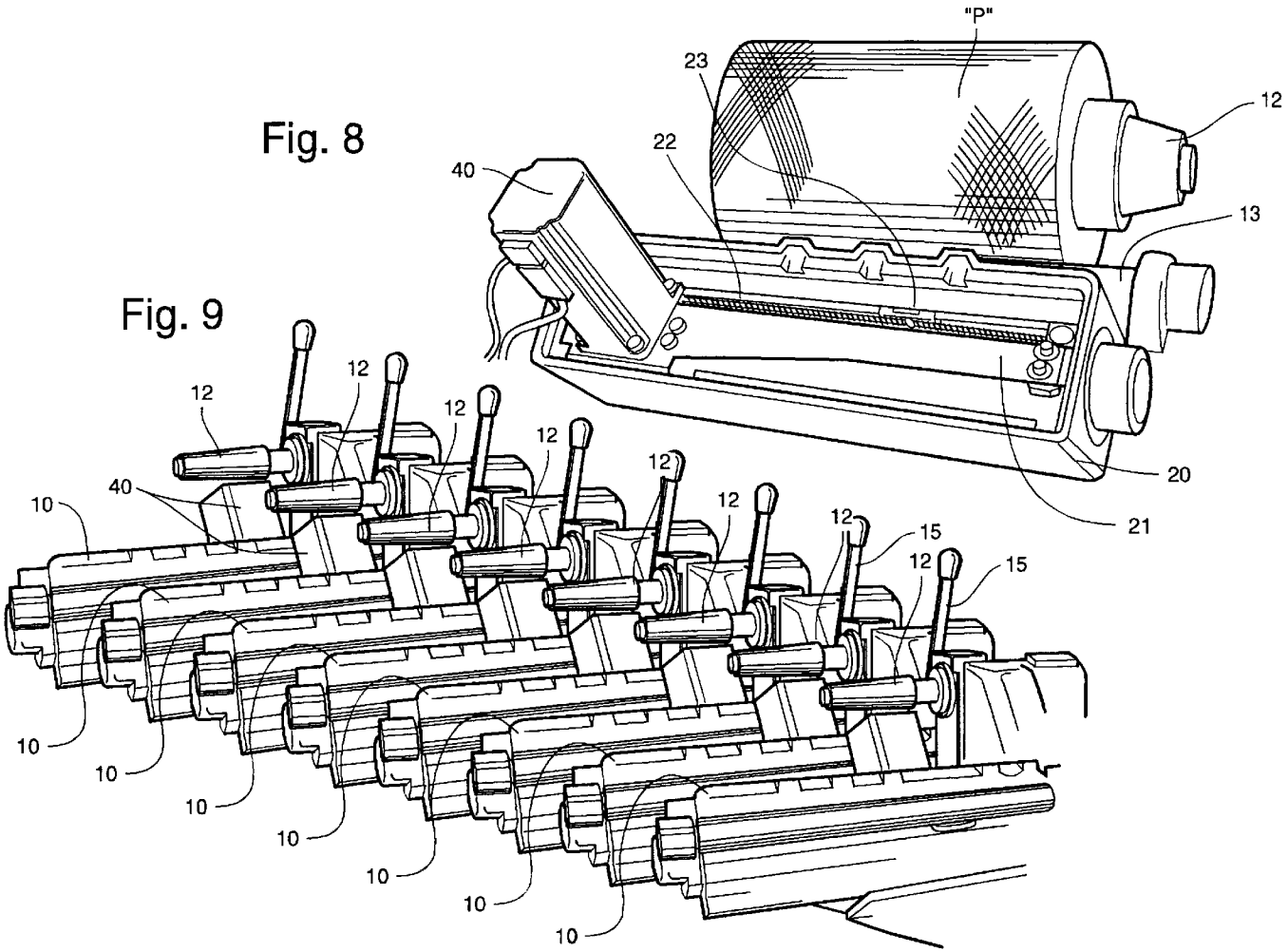
FIG. 8 is a perspective view of a winder station equipped with the servo traverse assembly shown in FIGS. 1–3 in the winding position from a direction generally opposite the position shown in FIG. 5.
FIG. 9 is a fragmentary perspective view of a multiple station winder equipped with servo traverse assemblies according to a preferred embodiment of the invention.

As is shown in FIG. 8, the servo traverse assembly 10 is positioned to be adjacent to the drive roll 13 in position to apply the yarn in a controlled manner directly to the surface of the rotating package "P". As is shown in FIG. 9, a plurality of servo traverse assembles 10 will typically be positioned adjacent each other on a winder frame in a conventional manner for simultaneously winding multiple packages "P".

Figure 10:
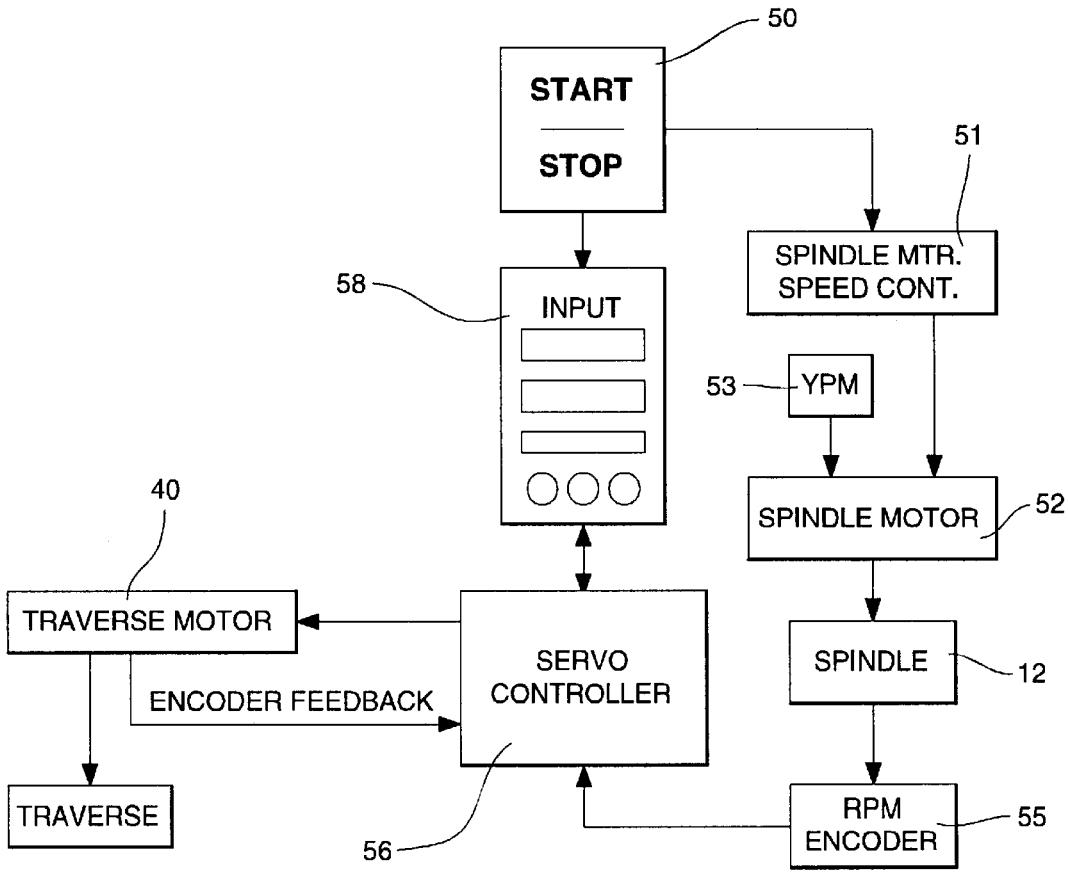
FIG. 10 is a schematic block diagram illustrating operation of the servo traverse assembly.

Referring now to FIG. 10, operation of the servo traverse assembly 10 is described. The servo traverse assembly is started and stopped in a conventional manner by a power switch 50. Power is delivered to a spindle motor speed controller 51 and to a spindle motor 52. The desired winding speed is input through a yarn speed input device 53. The spindle 12 is rotated through a belt and pulley arrangement in accordance with the prior art.

The spindle speed of the spindle 12 is detected by an encoder 55, which outputs a signal to a servo-controller 56. The servo-controller 56 outputs a signal to the servo-motor 40 which drives the drive cable 22 in coordination with the spindle 12. Feedback from the servo-motor 40 through a feedback loop results in a very precise real-time speed correction. As a result, yarn is applied to the package "P" in a very precise and at very high speed.

The servo-motor 40 includes an encoder which outputs a feedback signal indicative of the speed of the motor 40. Inputs, including traverse length, wind ratio, acceleration angle and deceleration angle are input through an input keypad 58, for example, an Allen-Bradley Panelview 300.

In a preferred application, yarn can be wound at up to 1000 yards per minute onto a tube mounted on a 3 11/16 inch tube holder, at between a 3.5 and 6.5 wind ratio with a 10 inch traverse stroke.

The servo-controller 56 is preferably an Allen-Bradley Motion Control System, including an Allen-Bradley PCL-5 programmable logic controller. Electronic control of the system allows for infinite variation of the traverse length and wind ratio, providing improved machine flexibility, faster machine setup changes, reduced maintenance, reduced machine noise, and the ability to modify older, obsolete machines.

Tapered packages are capable of being wound, as well as the more conventional tubular packages. The servo-controller 56 that controls the servo-motor 40 also execute the motion control program, eliminating the need for an external motion controller. Interface to the winder is of a standard serial port.

Figure 11:
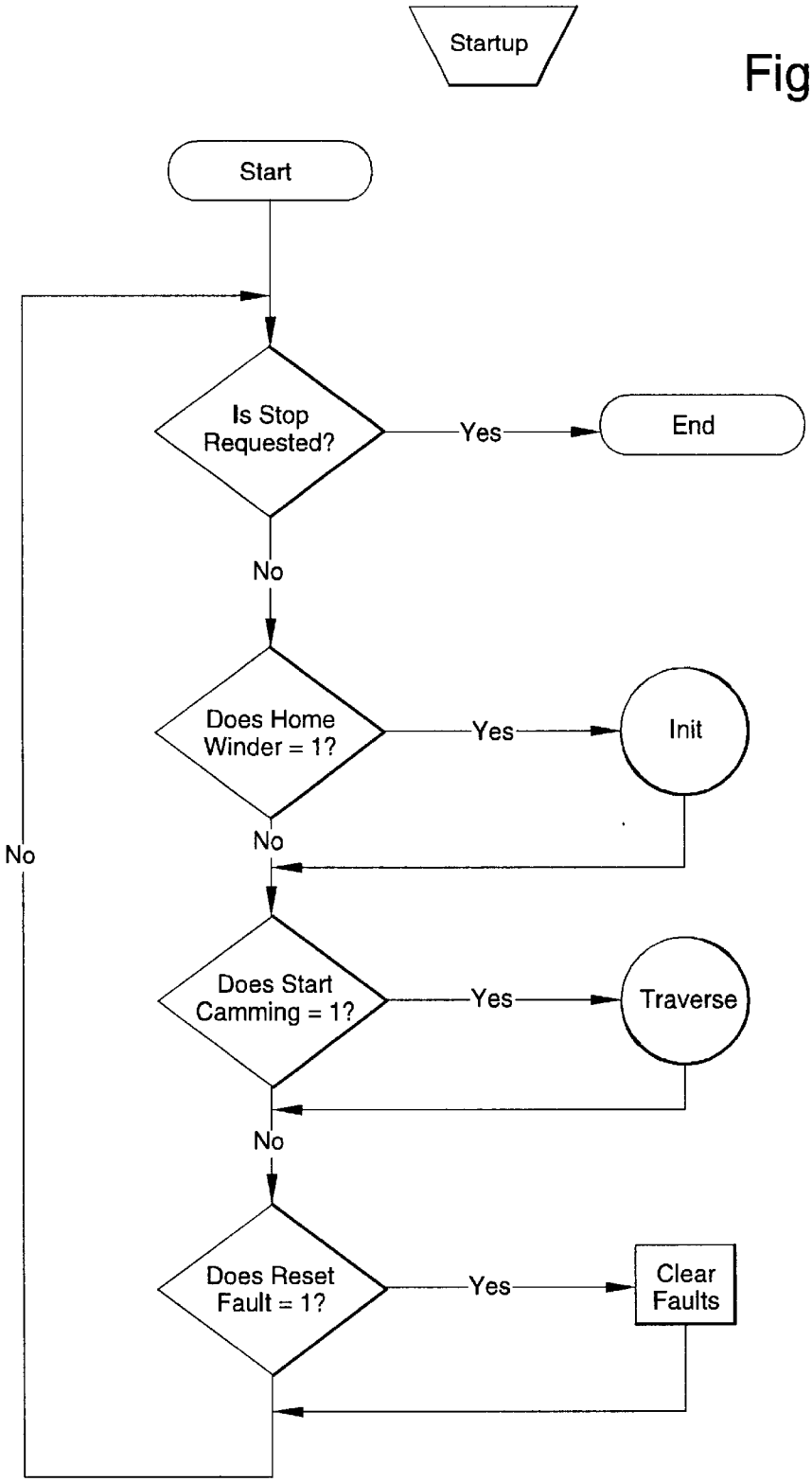
FIGS. 11, 12 and 13 flow diagrams of the servo traverse assembly illustrating startup, initialization and traverse program functions.
Figure 12:
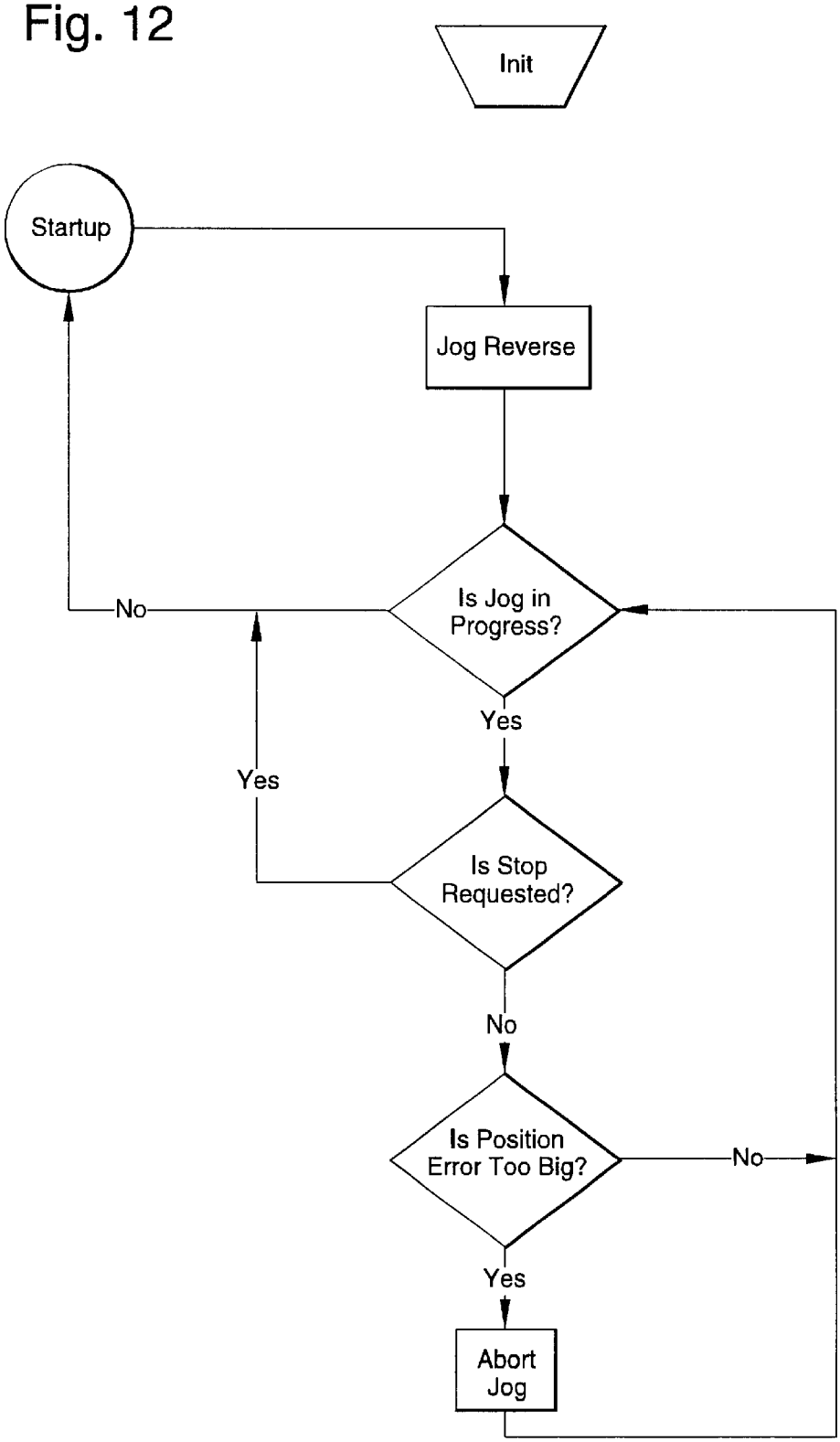
Figure 13:
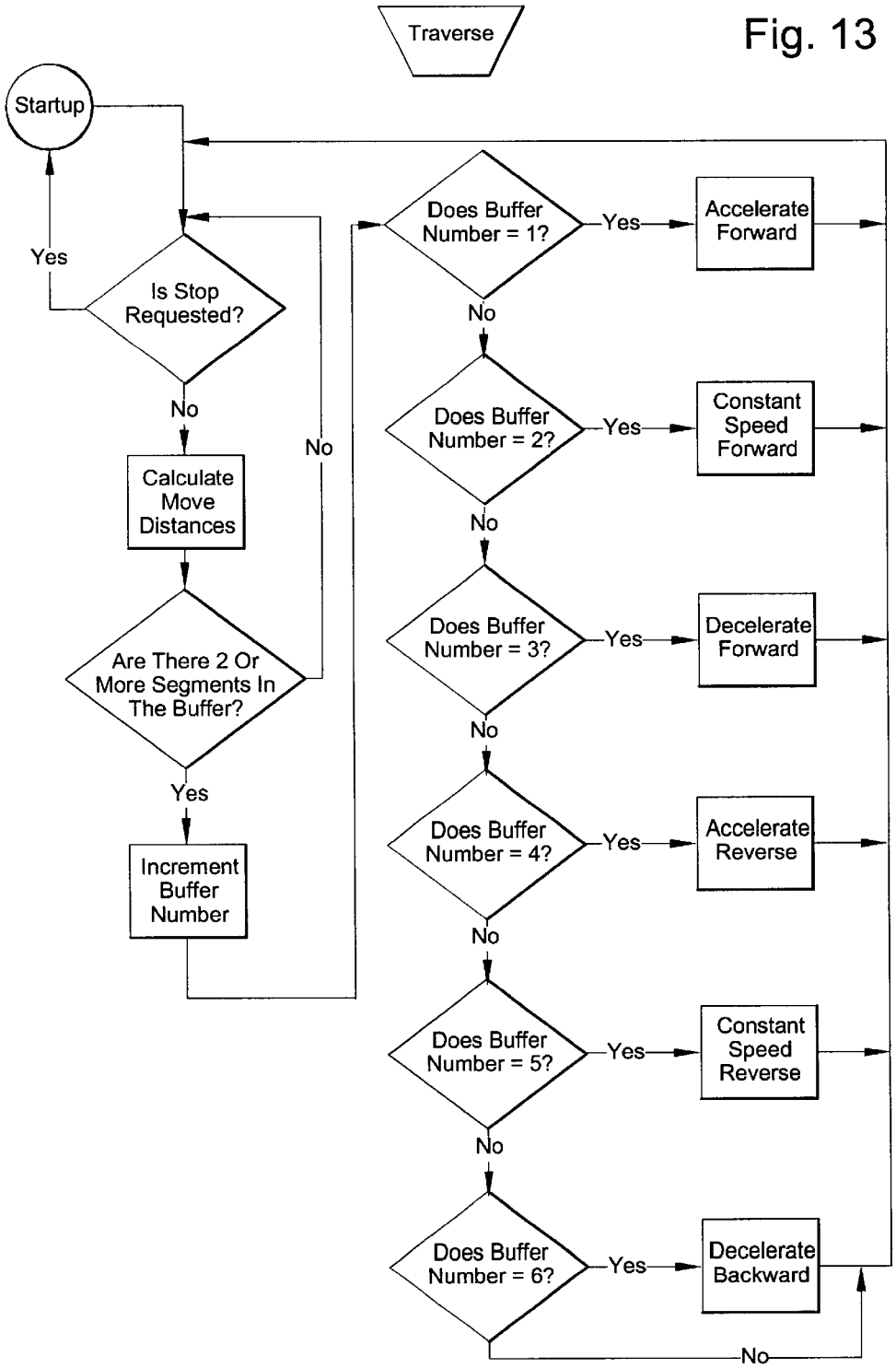

Referring mow to FIGS. 11, 12 and 13, flow diagrams for the startup, initialization and traverse functions are illustrated in standard flow diagram format.

A servo traverse assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A winding machine for winding a strand onto a tubular support to form a strand package, and comprising:

(a) a spindle on which the tubular support is mounted for rotation therewith, (b) a direct drive motor for rotating the spindle;

(c) a reciprocating traverse mechanism, including a strand guide, for guiding the strand onto the tubular support at a predetermined traverse stroke and wind ratio, said traverse mechanism comprising:

(i) a servo-motor for selectively starting and stopping reciprocating movement of the strand guide in accordance with the predetermined traverse stroke and wind ratio;

(ii) a programmable servo-controller for accepting data inputs reflecting the desired traverse stroke and wind ratio and for outputting data to the servo-motor reflecting the desired traverse stroke and wind ratio;

(iii) first and second cable pulleys positioned in spaced-apart relation along a rotational axis of the spindle, the first cable pulley being driven by the servo-motor;

(iv) a drive cable having first and second opposed ends attached to and carrying the strand guide therebetween, said drive cable extending around the first and second cable pulleys for being reciprocated by the starting and stopping reciprocating movement of the servo-motor under control of the servo-controller for moving the strand guide back-and-forth along the length of the spindle as the strand is wound onto the tubular support; and (v) said drive cable comprising a core member ground which is wound a spiral member in a predetermined angle and spacing to define raised driving convolutions on the surface of the core, the first and second cable pulleys each being provided with a plurality of regularly-spaced helical grooves on an outer peripheral driving surface thereof complementary with the driving convolutions on the surface of the core of the drive cable.

2. A winding machine according to claim 1, wherein the spindle is rotated at a constant strand winding speed, and including a speed sensor for detecting the surface speed of the strand package, a spindle motor speed controller for accepting a signal output from the speed sensor representing the surface speed of the strand package and outputting a signal representing the surface speed of the strand package:

(a) to the spindle motor speed controller for slowing the rpm of the spindle as the diameter of the strand package increases to maintain a constant spindle surface winding speed; and (b) to the servo-controller for slowing the traverse servo-motor in synchronization with the slowing of the rpm of the strand package and thus maintaining a constant wind ratio.

3. A winding machine according to claim 1, wherein said core member comprises a bundle of stranded stainless steel wire encapsulated in a flexible elastomeric jacket.

4. A winding machine according to claim 1, wherein said strand support is a constant diameter tube, and said the strand comprises a textile yarn.

5. A method of winding a strand onto a tubular support to form a strand package, and comprising the steps of:

(a) providing a spindle on which the tubular support is mounted for rotation therewith, a direct drive motor for rotating the spindle, and a reciprocating traverse mechanism, including a strand guide, for guiding the strand onto the tubular support at a predetermined traverse stroke and wind ratio, wherein the step of reciprocating the traverse mechanism comprises the steps of:

(i) providing first and second cable pulleys positioned in spaced-apart relation along a rotational axis of the spindle, the first cable pulley being driven by a servo-motor;

(iii) providing a drive cable having first and second opposed ends attached to and carrying the strand guide therebetween, said drive cable being passed around the first and second cable pulleys for being moved in opposite directions by the starting and slopping reciprocating movement of the servo-motor under control of a servo-controller for moving the strand guide back-and-forth along a length of the spindle as the strand is wound onto the tubular support;

said drive cable comprises a core member around which is wound a spiral member in a precise predetermined angle and spacing to define raised driving convolutions on the surface of the core, the first and second cable pulleys each being provided with a plurality of regularly-spaced helical grooves on an outer peripheral driving surface thereof complementary to the raised driving convolutions on the drive cable;

(b) generating data inputs reflecting the desired predetermined traverse stroke and wind ratio;

(c) outputting data to the servo-motor driving the strand guide, said data reflecting the desired traverse stroke and wind ratio; and (d) selectively starting and stopping the servo-motor and thus the reciprocating movement of the strand guide in accordance with the predetermined stroke and wind ratio.

6. A method according to claim 5, including the steps of:

(a) rotating the spindle at a constant strand winding speed, (b) detecting the surface speed of the strand package;

(c) outputting a signal representing the surface speed of the strand package to the servo-controller and outputting a signal representing the surface speed of the strand package:

(i) for slowing the rpm of the spindle as the diameter of the strand package increases to maintaining a constant spindle surface speed; and (ii) to the servo-controller for slowing the traverse servo-motor in synchronization with the slowing of the rpm of the strand package and thus maintaining a constant wind ratio.

* * * * *

UNITED STATES PATENT AND TRADEMARK OFFICE

CERTIFICATE OF CORRECTION

PATENT NO. : 6,776,367 B2
DATED : August 17, 2004
INVENTOR(S) : George W. McMurtry It is certified that error appears in the above-identified patent and that said Letters Patent is hereby corrected as shown below:

Column 8,
Line 16, delete “slopping” and insert -- stopping --.

Signed and Sealed this

Fifth Day of October, 2004

JON W. DUDAS
*Director of the United States Patent and Trademark Office*